US005966891A

United States Patent [19]

Fagan et al.

[11] Patent Number: 5,966,891

[45] Date of Patent: Oct. 19, 1999

[54] CORNER SIDING PIECE FOR ADJACENT J-CHANNEL RETAINER STRIPS

[75] Inventors: Mark A Fagan; Michael A Fagan, both of Oak Ridge, Tenn.

[73] Assignee: Mark A. Fagan, Oak Ridge, Tenn.

[21] Appl. No.: 09/071,112

[22] Filed: May 4, 1998

Related U.S. Application Data

[60] Provisional application No. 60/045,737, May 6, 1997.

[51] Int. Cl.[6] ..... E04C 2/38

[52] U.S. Cl. ..... 52/656.9; 52/212; 52/478; 52/526; 52/546

[58] Field of Search ..... 52/518, 519, 520, 52/522, 526, 545, 546, 547, 211, 212, 656.2, 656.4, 656.5, 656.9, 478, 658

[56] References Cited

U.S. PATENT DOCUMENTS

| | | | |
|---|---|---|---|
| 2,427,762 | 9/1947 | Carr . | |
| 2,849,757 | 9/1958 | Meldrum . | |
| 4,334,396 | 6/1982 | Hagopian | 52/522 |
| 4,608,800 | 9/1986 | Fredette | 52/656 |
| 4,864,787 | 9/1989 | Bukowski | 52/284 |
| 5,347,784 | 9/1994 | Crick et al. | 52/520 |
| 5,625,992 | 5/1997 | Strick et al. | 52/656.9 |
| 5,678,367 | 10/1997 | Kline | 52/211 |

*Primary Examiner*—Christopher T. Kent
*Assistant Examiner*—Yvonne Horton-Richardson

[57] ABSTRACT

When installing vinyl siding on homes or other type buildings, a drawback to the trim pieces around windows, doors, etc., is the method of connecting two (2) retainer strips (J-Channels) together. The original method is to miter the horizontally and vertically placed retainer strips together. This method has proven to be too time consuming and is not neat in appearance. Since then, another way was invented. The new method being a corner piece that must be affixed to the structure having the siding installed. This, too, proved to be time consuming. Our invention is a corner siding piece having an L-shaped base plate with a first leg integral with a second leg, both of which have a first flange and a second flange extending inwardly at the bottom and a curved channel along the top of said first leg and second leg. It is affixed on top of the retainer strip (J-Channel) by placing the back of said base plate into the front facing of the already installed retainer strip (J-Channel) and snapping the curved channel of said first leg and second leg onto the top of said retainer strip while the inwardly extension of said first flange and second flange go underneath the bottom of the already installed said retainer strips (J-Channels). The inwardly curved channels and inwardly extended flanges will cause said corner siding piece to be affixed securely onto said retainer strips covering said corners in a more time efficient manner, giving a neater appearance.

3 Claims, 3 Drawing Sheets

Fig. 2.A,
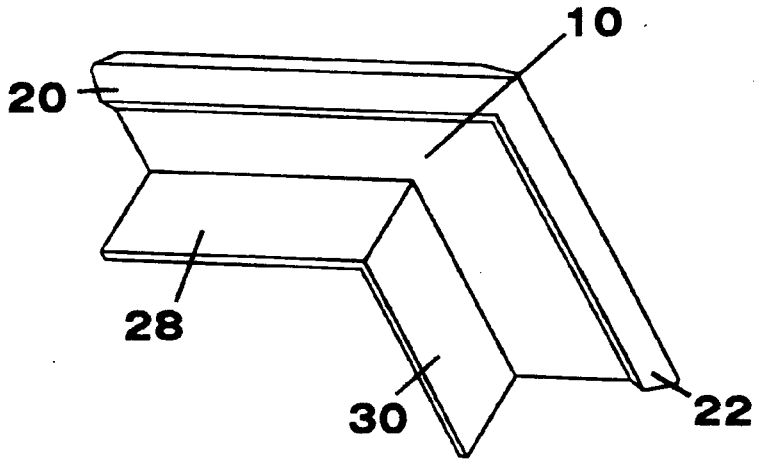
Fig. 2.B,
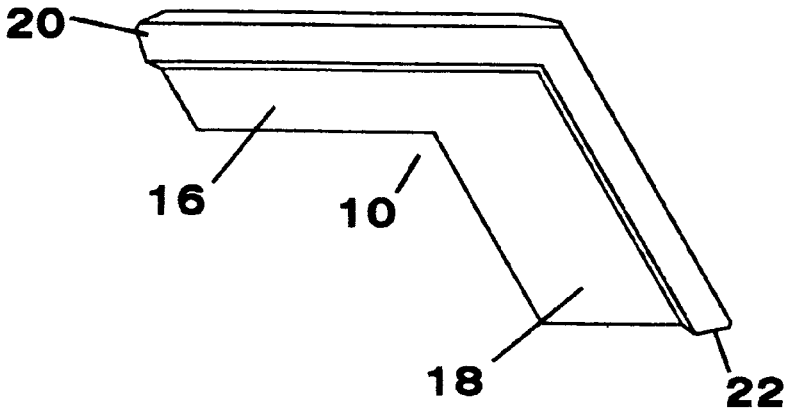

CORNER SIDING PIECE FOR ADJACENT J-CHANNEL RETAINER STRIPS

This application claims the benefit of provisional application No. 60/045,737 filed May. 6, 1997.

BACKGROUND—FIELD OF INVENTION

This invention relates to a corner siding piece for use with a J-Channel (J-Channel being used as trim pieces around horizontal and vertical structures such as windows, doors, etc.). The corner siding piece for use with a J-Channel connects two (2) pieces of J-Channel where they meet at a right angle.

BACKGROUND—DESCRIPTION OF PRIOR ART

The background of the prior art relates to mitering of the J-Channel. At right angles (such as doors, window, etc.), two (2) pieces of J-Channel are cut so as to fit together to form the right angle. A drawback of this prior art is that it is not neat in appearance. The J-Channel is affixed to the structure but protrudes away from the building.

BACKGROUND—MORE PRIOR ART

Another prior art form for connecting two (2) pieces of J-Channel is Pat. No. 4,608,800 belonging to Richard Fredette, dated Sep. 2, 1986. This prior art is a corner piece for vinyl siding that is used by fastening said corner piece to the structure to which the siding is installed. A major significance to the difference of the two inventions is that our corner siding piece does not affix to the building structure, it only affixes to the J-Channel itself.

The objective of this invention is to provide a corner siding piece for covering junctions between adjacent horizontal and vertical J-Channels (retainer strips) which retain siding around right-angles openings such as doors and windows. And, furthermore, the objective of this invention is to give a more pleasant appearance in a more timely manner.

SUMMARY OF THE INVENTION

We are providing a corner siding piece for use with a retainer strip (J-Channel); which is to say a corner siding piece for covering the junctions between adjacent horizontal and vertical retainer strips (J-Channels).

The corner siding piece comprises an L-shape having a front base plate with a first leg integral with the second leg. The fist leg and second leg are both defined by an inner and outer edges, both extending inwardly at the bottom of said base plate. The top of said base plate curves inwardly to form a channel parallel with the first leg and the second leg, the curved channel being defined with an inner and an outer edge.

At each corner where the retainer strips (J-Channels) meet to form the angle, one corner siding piece is placed with the back of the base plate over the front of the retainer strips (J-Channels), with the first leg and second leg extending inwardly toward the building structure, overlapping the bottom legs of the retainer strips (J-Channels). Along the top, the curved channels, being defined with an inner and an outer edge, overlap the top channel of the retainer strips (J-Channels) so as to snap securely onto the retainer strips (J-Channels), giving a secure fit while holding the corner edges together.

DRAWING FIGURES

FIG. 2A, shows the back of the corner siding piece.

FIG. 2B, shows a front view of the corner siding piece.

DETAILED DESCRIPTION OF THE PREFERRED EMBODIMENT

Figure 1:
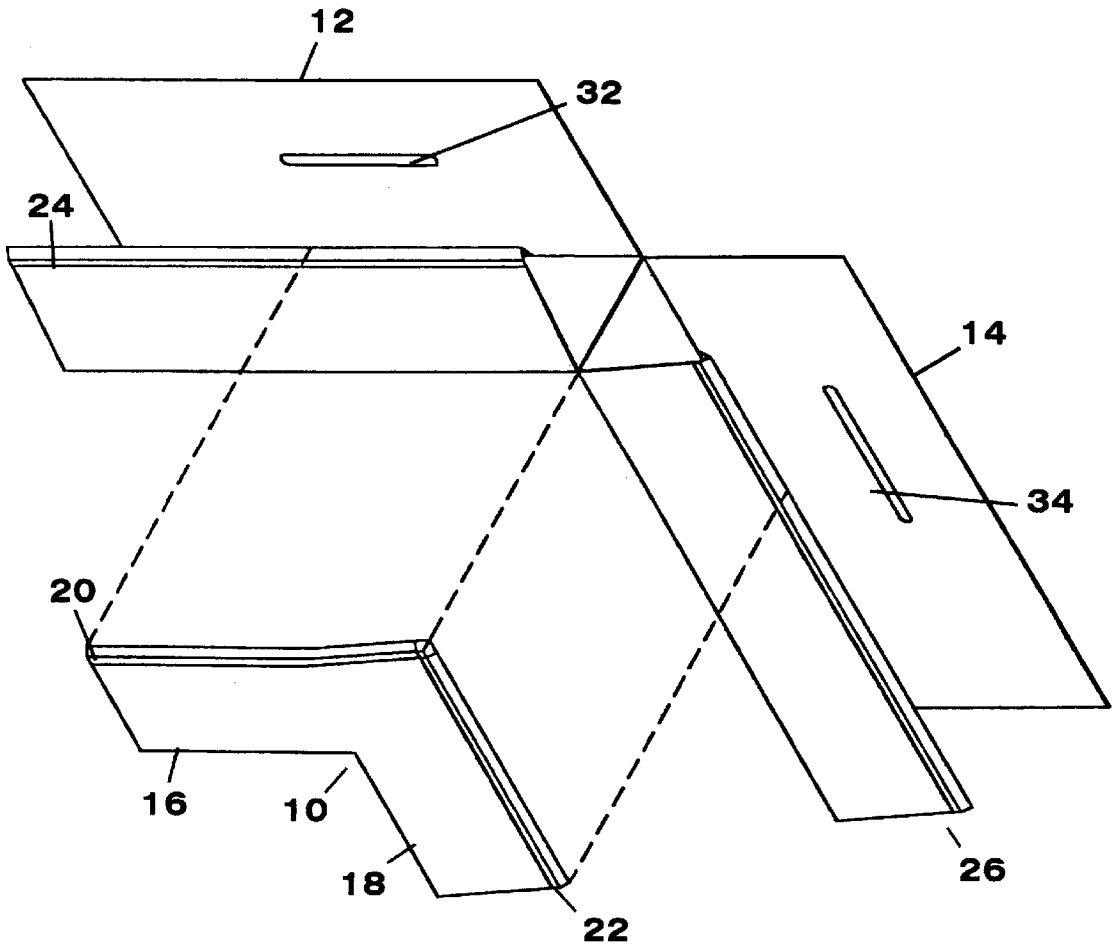
FIG. 1, is a view of two (2) J-Channels with a nail flange on the back and the corner siding piece coming into view to fit the two (2) J-Channels together.

In FIG. 1, a corner siding piece 10 is shown coming together with a horizonal retainer strip (J-Channel) 12 and vertical retainer strip (J-Channel) 14. Retainer strips 12 and 14 are known in the art as J-Channels used for retaining siding around right-angled openings such as doors and windows, both having horizontal frame components and vertical frame components. A corner siding piece 10 comprises a generally L-shaped vinyl base plate having a first leg 16 integral with a second leg 18. Said first leg 16 and second leg 18 having inwardly curved channels 20, 22 for overlapping the retainer strips curved channels 24, 26 and also said first leg 16 and second leg 18 having a first 28 and second 30 flange (FIG. 2A), for a secure fit around said retainer strips 12, 14, (FIG. 1).

Figure 3A:
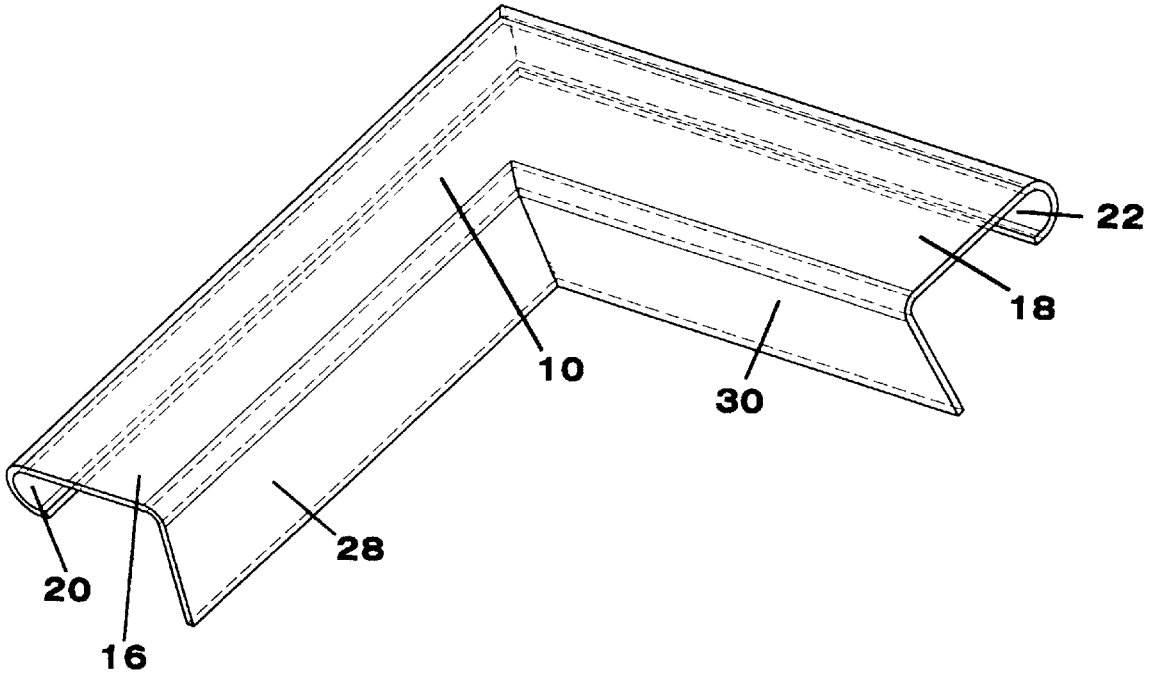
FIG. 3A, shows a front view with a dotted outline to better show the curved channel which snaps around the J-Channel.
Figure 3B:
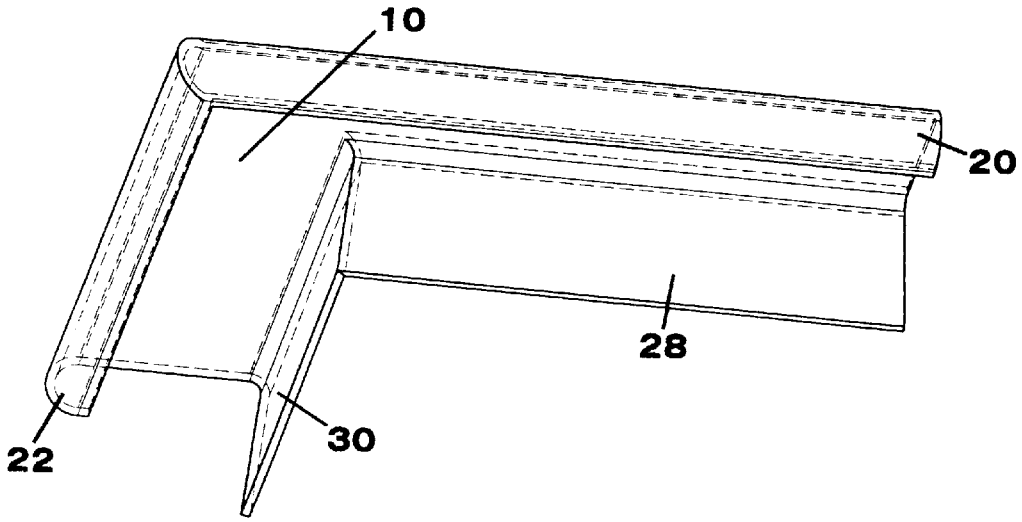
FIG. 3B, shows a back view with a dotted outline to better show the first leg and second leg extending inwardly.

FIG. 3A shows a dotted outline from the front view. The base plate is shown with a smooth surface, but may have a grained finish. The top of the first leg 16 and second leg 18 show the inwardly curved channels 20, 22 which help along with the inwardly extended first flange 28 and second flange 30 to secure the corner siding piece to the retainer strips 12, 14 which is secured to a the wall by a nail slots at 32, 34, (FIG. 1).

We claim:

1. A corner siding piece for covering junctions between adjacent horizontal and vertical J-channel retainer strips which retain siding to a wall around right angled openings in said wall, the corner piece comprising:

a generally L-shaped base plate for covering a front facing of said retainer strip having a first leg integral with a second leg and a first and second flange for preventing water drainage extending downwardly therefrom and inwardly towards the wall; wherein the first and second leg each have an inwardly curved channel along a top edge thereof for fitting over the J-channel retainer strips.

2. The corner siding piece of claim 1 wherein the corner siding piece is vinyl.

3. The corner siding piece of claim 1 wherein the corner siding piece is one (1) solid piece comprising:

a base plate having a smooth back surface and a grained front surface.

* * * * *